United States Patent [19]

Jensen et al.

[11] Patent Number: 5,010,612

[45] Date of Patent: Apr. 30, 1991

[54] METHOD FOR CONTINUOUS DYEING OF TUBULAR COTTON KNIT FABRICS

[75] Inventors: Aage Jensen, Vanlose; Jeppe Stingsen; Jakob Landberg, both of Frederiksberg, all of Denmark

[73] Assignee: Vald. Henriksen A/S, Soborg, Denmark

[21] Appl. No.: 438,413

[22] PCT Filed: May 27, 1988

[86] PCT No.: PCT/DK88/00085

§ 371 Date: Nov. 21, 1989

§ 102(e) Date: Nov. 21, 1989

[87] PCT Pub. No.: WO88/09410

PCT Pub. Date: Dec. 1, 1988

[30] Foreign Application Priority Data

May 29, 1987 [DK] Denmark ..... 2780/87

[51] Int. Cl.[5] ..... D06B 3/12

[52] U.S. Cl. ..... 8/149.1; 8/151; 8/158; 68/5 E; 68/9; 68/13 R

[58] Field of Search ..... 8/149.1, 151, 158; 68/5 D, 5 E, 9, 13 R

[56] References Cited

U.S. PATENT DOCUMENTS

| | | | |
|---|---|---|---|
| 3,451,077 | 6/1969 | Meier-Windhorst et al. | 68/9 X |
| 4,747,190 | 5/1988 | Koch | 68/13 R X |
| 4,843,669 | 7/1989 | Koch et al. | 68/13 R X |

FOREIGN PATENT DOCUMENTS

| | | | |
|---|---|---|---|
| 0015581 | 1/1984 | Japan | 8/151 |

*Primary Examiner*—Philip R. Coe

*Attorney, Agent, or Firm*—Scully, Scott, Murphy & Presser

[57] ABSTRACT

A method for continuous dyeing of tubular cotton knit fabrics with reactive dyes, in which method the fabric passes through a padding phase, optionally a swelling phase, a levelling phase, conducted in a steamer, a fixation phase conducted in the steamer, and a washing out, and in which the tubular fabric is ballooned at least once in the levelling phase, characterized in that before each ballooning in the levelling phase the length of fabric is passed through a bath of a neutral, inert salt and after each ballooning is squeezed to approximately the same moisture content as at the inlet to the salt bath, the squeezed off liquid being recirculated to the salt bath.

4 Claims, 2 Drawing Sheets

METHOD FOR CONTINUOUS DYEING OF TUBULAR COTTON KNIT FABRICS

TECHNICAL FIELD

The present invention concerns a method for continuous dyeing of tubular cotton knit fabrics with reactive dyes, in which method the fabric passes through a padding phase, optionally a swelling phase, a levelling phase, a steaming phase, and a washing out, and in which the tubular fabric is ballooned one or several times at least in the levelling phase.

BACKGROUND ART

A method for continuous dyeing of woven cotton fabrics has been known for a long time, in which method the fabric passes through a padding machine followed immediately by a steamer and is subsequently washed out.

Such a method cannot be used for cotton knot fabrics because a cut knit fabric is not sufficiently dimensionally stable, and because it is not possible to prevent the edges of the length of fabric from rolling up.

It is preferred to use uncut tubular fabric, but said fabric is encumbered with the drawback that the two edges resulting from the squeezing procedure in the padding machine absorb a great amount of dyestuff and therefore appear as dark stripes. In connection with vat dyeing attempts have been made to solve this problem by ballooning the tubular fabric one or several times during its passage through the steamer in which the fixation occurs, cf. German Offenlegungsschrift No. 3.422.759.

The present invention is based on the same technique, i.e. ballooning the tubular fabric one or several times during its passage through the steamer.

Dyeing with reactive dyes is, however, encumbered with a different problem than dyeing with vat dyes as the latter method requires a feeding of fixation chemicals. These fixation chemicals are very conveniently fed through the liquid locks forming the inlet and the outlet of the steamer. Fabrics dyed with reactive dyes do not require a feeding of fixation chemicals and can pass through the steamer directly from the padding or the swelling phase provided the ballooning technique is not used in the steamer. When the latter technique is used it is necessary that the length of fabric passes a lock such as a trap, in order to maintain the pressure inside the steamer. The latter procedure has, however, a damaging effect on the fabric dyed with reactive dyes because the dye is washed out by water.

DISCLOSURE OF THE INVENTION

According to the present invention the above problem has been solved by the length of fabric passing through a bath of a neutral, inert salt before each ballooning in the steamer and being squeezed to approximately the same moisture content as at the inlet to the salt bath after each ballooning, the squeezed off liquid being recirculated to the salt bath. In this manner the colour is preserved in the levelling phase at the same time as the salt consumption is minimized and the environment is not polluted by large amounts of salt.

However, as it cannot be avoided that the length of fabric absorbs some salt, the concentration of the salt bath is according to the invention suitably maintained by dosing salt.

The above dosing of salt is suitably carried out by the salt bath being kept in constant circulation to an outer vessel in which the concentration of salt is measured and the dosing of salt is carried out.

The measuring is suitably carried out by measuring the conductivity, but can also be carried out for instance by measuring the specific gravity.

The slat bath is a strong solution of a neutral, inert salt, such as common salt (NaCl), for instance in a concentration up to 250 g/l.

In addition to the concentration of the salt bath also the temperature of said bath affects the dye absorption, and therefore said temperature is suitable kept constant for instance in the range of 70°-90° C. This necessitates a heating of the salt bath at the beginning of the process and a cooling thereof later on in the process because the temperature inside the steamer must be kept at at least 100° C. for instance by blowing in steam or by means of an evaporator situated below the length of fabric.

BRIEF DESCRIPTION OF DRAWING

The invention is described in greater detail below with reference to the accompanying drawing, in which FIGS. 1 and 2 in extension of one another illustrate part of a system for carrying out the method according to the invention.

BEST MODE FOR CARRYING OUT THE INVENTION

Figure 1:
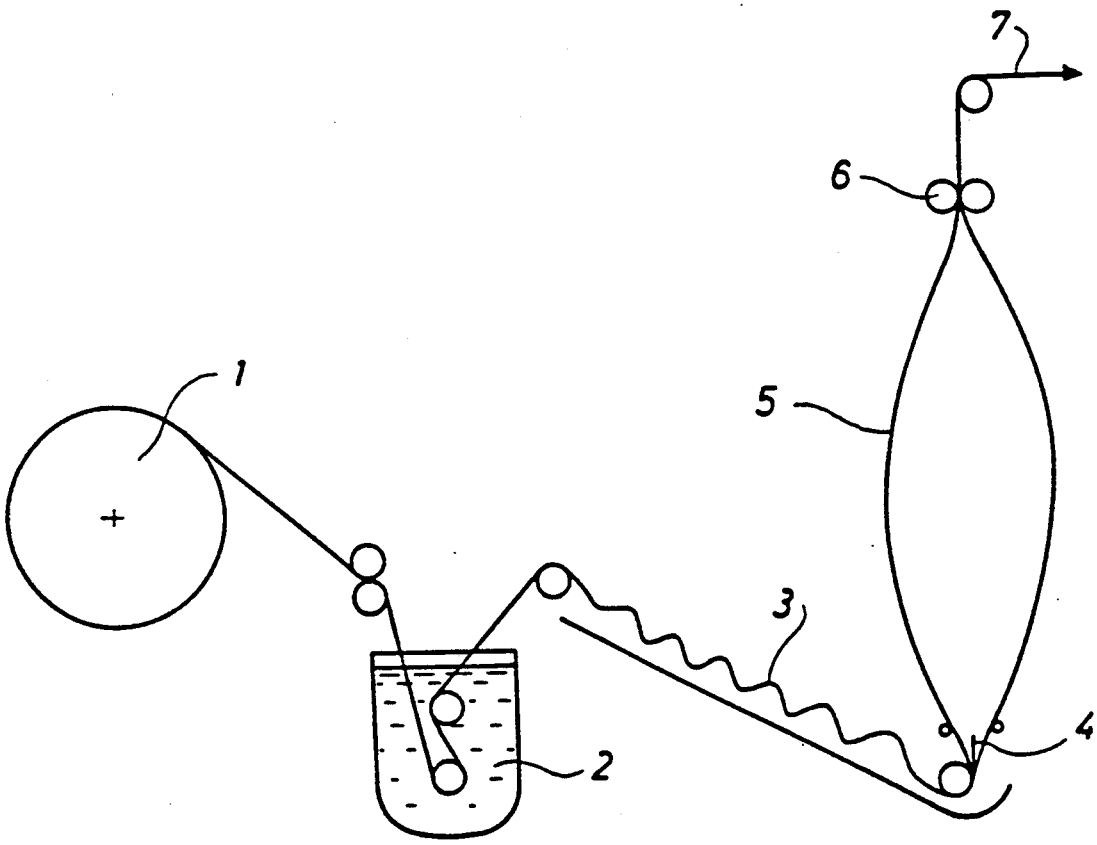

FIG. 1 illustrates the first part of the system in which a tubular cotton knot fabric from a roll 1 passes through a bath 2 with reactive dye and then through a relaxation step or a swelling step 3 to an inflating step 4, in which the length of fabric is ballooned 5 by means of air blown in. Subsequently, the ballooned fabric is squeezed together by means of a pair of squeezing rollers 6 pressing the liquid out of the length of fabric.

Figure 2:
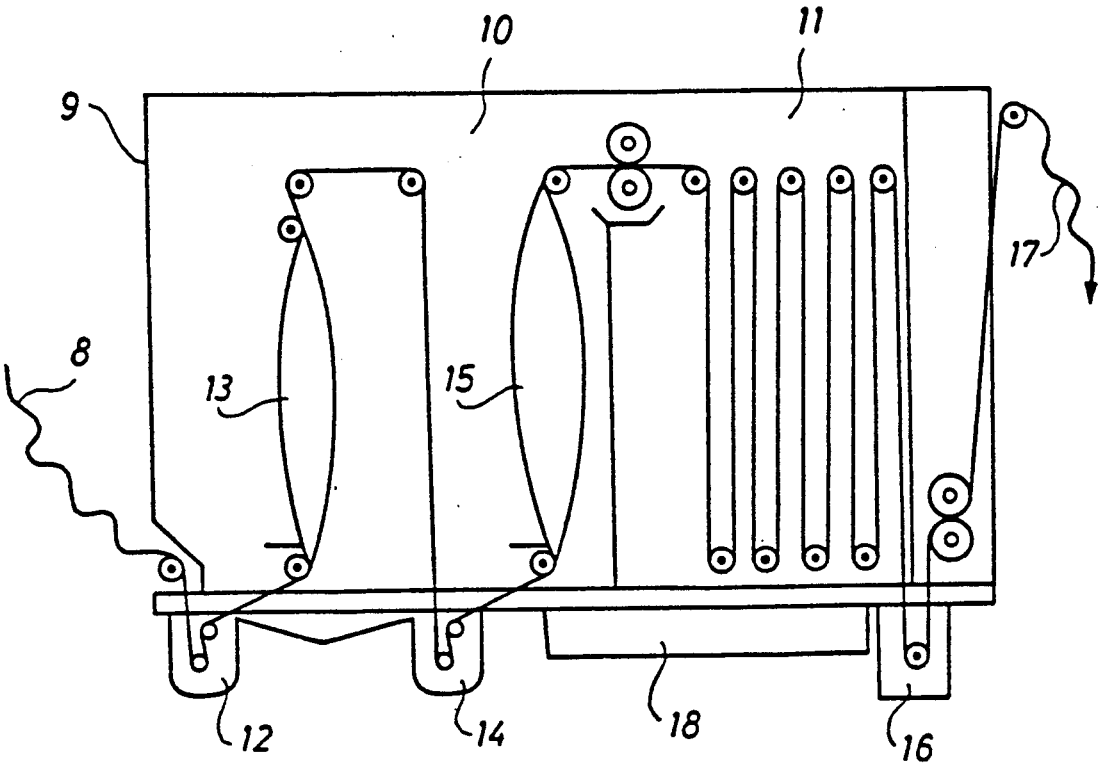

From this padding step known per se the length of fabric 7 passes through a further relaxation step 8, cf. FIG. 2, to the steamer 9 which comprises a levelling section 10 and a fixation section 11. At the inlet to the steamer the length of fabric passes through a salt bath 12 and then a first ballooning step 13 in which the tubular length of fabric is ballooned. Subsequently, the length of fabric passes through a salt bath 14 connected to the bath 12 and then through a second ballooning step 15. After each ballooning step the liquid is squeezed out of the length of fabric to the same moisture content as at the entrance of the length of fabric into the salt bath 12 or 14. The liquid runs downwards on the outside and the inside of the balloon with the effect that thereby the knit fabric becomes so tight that the slight overpressure necessary for the ballooning can be maintained. The liquid returns to the interconnected salt baths 12 and 14 which communicate with a vessel (not shown) placed outside the steamer and in which the dosing of salt takes place after the measuring of the concentration.

Having passed the levelling section in which an initial fixation takes place there is no longer any risk of nonuniform dyeing, and the length of fabric then passes through the fixation section 11 in which the noninflated length of fabric passes between a number of rollers. The length of fabric leaves the steamer through a liquid lock 16 applicable as a cooling and rinsing bath and passes then through a relaxation step 17 to a washing out section known per se. The steam for the steamer is produced by an evaporator 18 situated below the length of fabric.

The three relaxation steps 3, 8, and 17 shown are possibilities which need not be used in all cases but which turned out to be suitable in connection with dyeing with reactive dyes. The number of ballooning steps in the steamer can vary and need not be two as illustrated in the drawing. The essential feature of the invention is that the length of fabric passes through a salt bath before each ballooning in the steamer, and that the length of fabric after each ballooning is squeezed to approximately the same moisture content as before the en trance to the salt bath, the squeezed off liquid being recirculated to the salt bath.

The invention concerns as mentioned tubular cotton knit fabrics. The expression cotton fabrics is here meant as fabrics containing cellulose fibres which may be a combination fabric. The method is meant for dyeing cotton or the cotton portion of such combination fabrics by means of reactive dyes.

We claim:

1. A method for continuous dyeing of tubular cotton knit fabrics with reactive dyes, in which method the fabric passes sequentially through the padding phase, optionally a swelling phase, a leveling phase conducted in a steamer, a fixation phase conducted in said steamer, and a washing out, and in which the tubular fabric is ballooned at least once in the leveling phase, characterized in that before each ballooning in the leveling phase the length of fabric is passed through a bath of a neutral, inert salt and after each ballooning in the leveling phase is squeezed to approximately the same moisture content as at the inlet to the salt bath, the squeezed off liquid being recirculated to the salt bath.

2. A method ad claimed in claim 1, characterized by the concentration of the salt bath being maintained by dosing salt.

3. A method as claimed in claim 2, characterised by the concentration of salt being measured and then the dosing of salt is carried out.

4. A method as claimed in claim 3, characterised by the concentration of salt being measured by measuring the conductivity.

* * * * *